US006407730B1

(12) United States Patent
Hori

(10) Patent No.: US 6,407,730 B1
(45) Date of Patent: Jun. 18, 2002

(54) LIQUID CRYSTAL DISPLAY DEVICE AND METHOD FOR TRANSFERRING IMAGE DATA

(75) Inventor: Yoshihiko Hori, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/442,455

(22) Filed: Nov. 18, 1999

(30) Foreign Application Priority Data

Nov. 19, 1998 (JP) ..... 10-344855

(51) Int. Cl.[7] ..... G09G 3/36
(52) U.S. Cl. ..... 345/100; 345/98
(58) Field of Search ..... 345/87, 98, 100; 349/73, 74; 348/790, 792

(56) References Cited

U.S. PATENT DOCUMENTS 5,192,945 A * 3/1993 Kusada ..... 340/784
5,214,760 A * 5/1993 Hammond et al. ..... 395/250
5,841,431 A * 11/1998 Simmers ..... 345/211
5,874,934 A * 2/1999 Ito ..... 345/98
6,020,874 A * 2/2000 Kurihara ..... 345/132
6,236,393 B1 * 5/2001 Ogawa et al. ..... 345/211

FOREIGN PATENT DOCUMENTS

JP 3-203775 9/1991
JP 6-45508 2/1994
JP 6-148665 5/1994
JP 7-199864 8/1995

OTHER PUBLICATIONS

Japanese Office Action dated March 21, 2001, with partial English Translation

* cited by examiner

*Primary Examiner*—Bipin Shalwala
*Assistant Examiner*—Nitin Patel
(74) *Attorney, Agent, or Firm*—McGinn & Gibb, PLLC

(57) ABSTRACT

A liquid crystal display device and method for displaying image data having a reduced number of connections between a signal processing circuit and source drivers, obtained by the serial transformation of image data, decreases the area occupied by wiring and the length of wiring on the printed circuit board, thus, decreasing electromagnetic interference among a otherwise larger number of longer data connections. The signal processing circuit of the liquid crystal display device is provided with at least two line memories, each having the capacity to store a line of displayed image data. A display line of image data is split into a number of split blocks of image data equal in number to a number of source drivers. Each of the split blocks of image data is transformed into image data in serial form and then transferred to one of the corresponding source drivers. In parallel transforming circuits included in the source drivers, the serial image data is transformed into image data in parallel form and outputted to a number of outputs in parallel to a liquid crystal display panel.

15 Claims, 12 Drawing Sheets

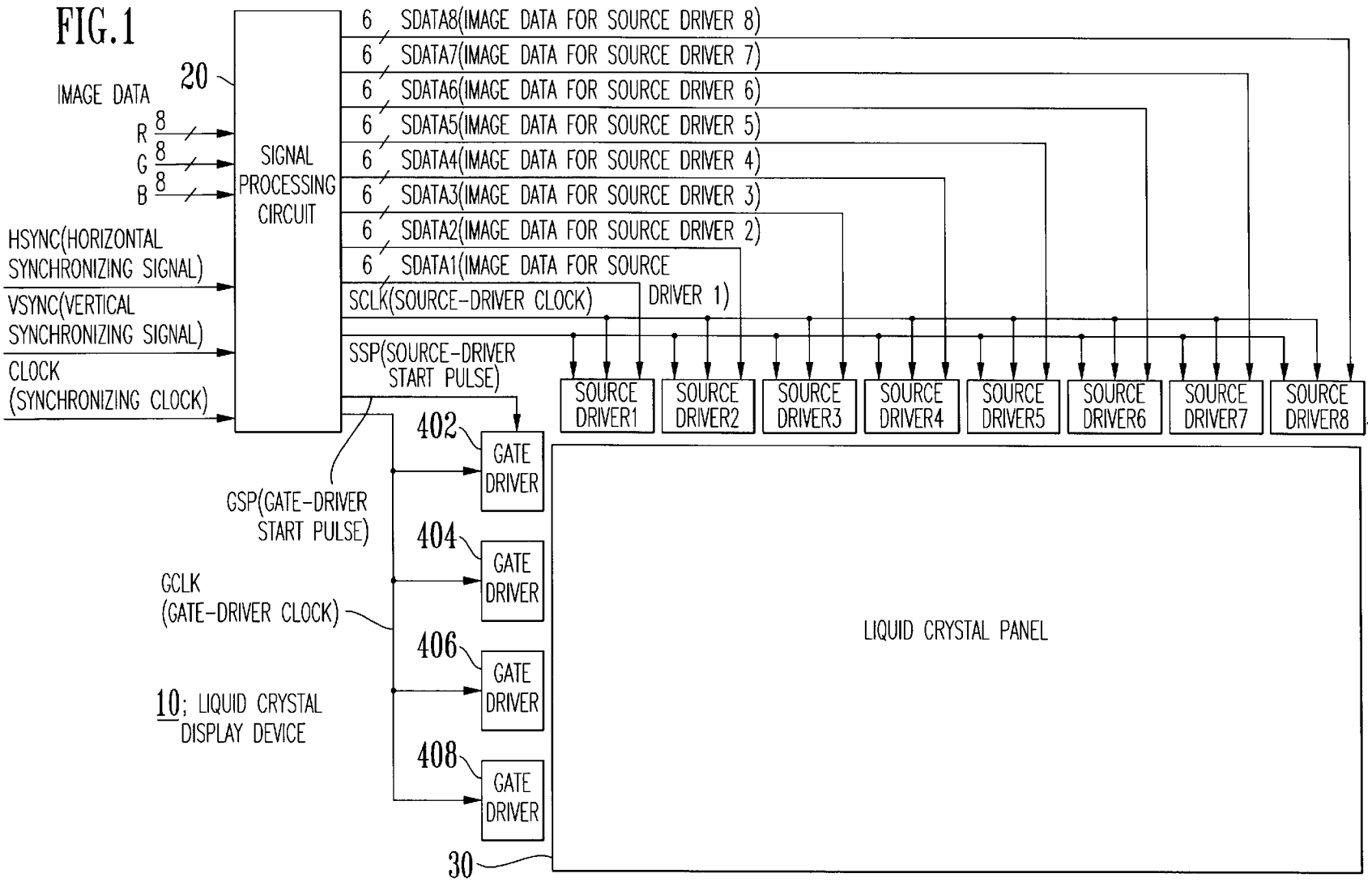
FIG.1
IMAGE DATA
R 8
G 8
B 8
20
SIGNAL PROCESSING CIRCUIT
6 SDATA8(IMAGE DATA FOR SOURCE DRIVER 8)
6 SDATA7(IMAGE DATA FOR SOURCE DRIVER 7)
6 SDATA6(IMAGE DATA FOR SOURCE DRIVER 6)
6 SDATA5(IMAGE DATA FOR SOURCE DRIVER 5)
6 SDATA4(IMAGE DATA FOR SOURCE DRIVER 4)
6 SDATA3(IMAGE DATA FOR SOURCE DRIVER 3)
6 SDATA2(IMAGE DATA FOR SOURCE DRIVER 2)
6 SDATA1(IMAGE DATA FOR SOURCE DRIVER 1)
SCLK(SOURCE-DRIVER CLOCK)
SSP(SOURCE-DRIVER START PULSE)
HSYNC(HORIZONTAL SYNCHRONIZING SIGNAL)
VSYNC(VERTICAL SYNCHRONIZING SIGNAL)
CLOCK (SYNCHRONIZING CLOCK)
SOURCE DRIVER1
SOURCE DRIVER2
SOURCE DRIVER3
SOURCE DRIVER4
SOURCE DRIVER5
SOURCE DRIVER6
SOURCE DRIVER7
SOURCE DRIVER8
LIQUID CRYSTAL PANEL
GATE DRIVER
402
404
406
408
30
GSP(GATE-DRIVER START PULSE)
GCLK (GATE-DRIVER CLOCK)
10; LIQUID CRYSTAL DISPLAY DEVICE

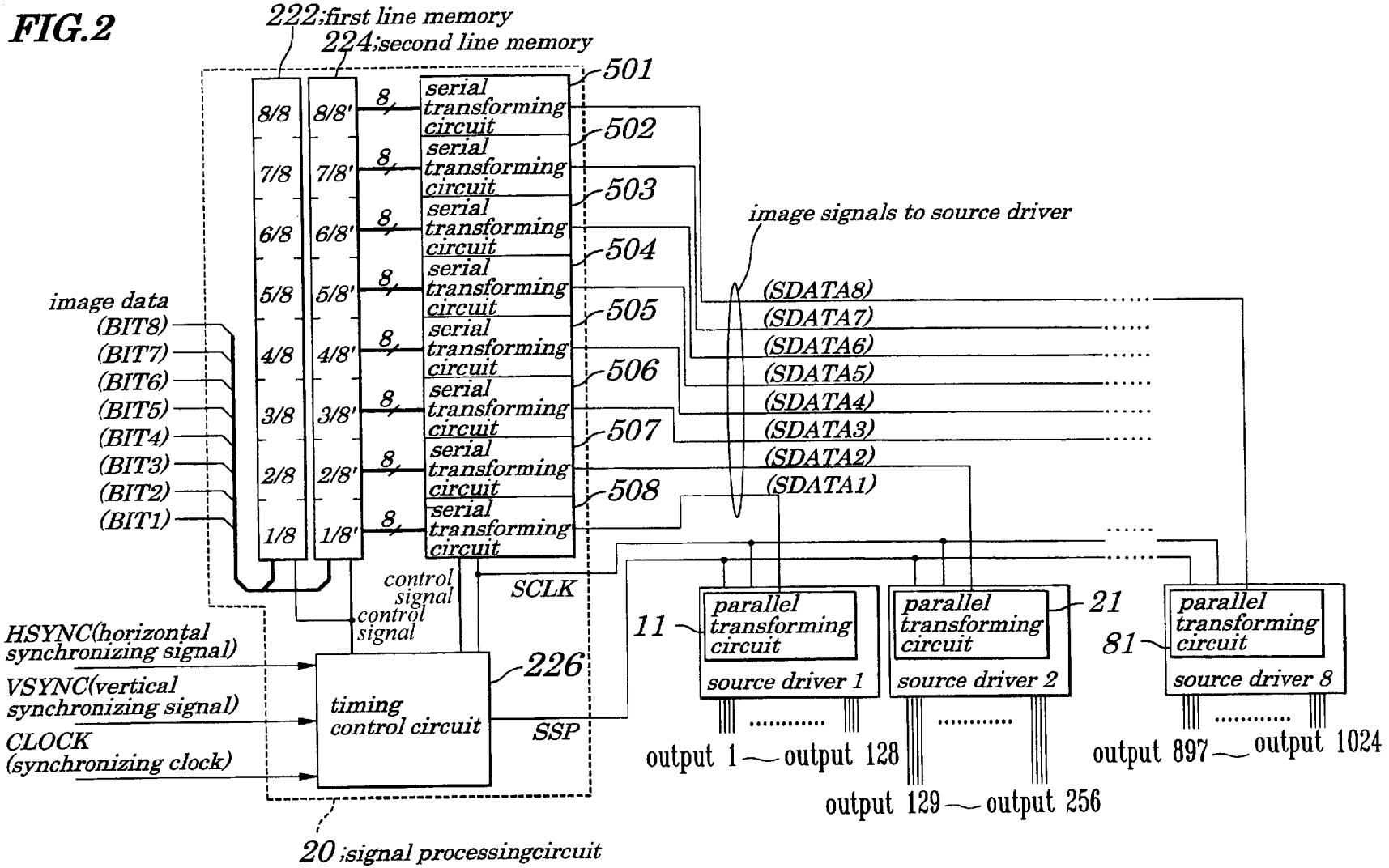
FIG.2
222:first line memory
224:second line memory
501
502
503
504
505
506
507
508
serial transforming circuit
8
8/8'
7/8'
6/8'
5/8'
4/8'
3/8'
2/8'
1/8'
8/8
7/8
6/8
5/8
4/8
3/8
2/8
1/8
image data
(BIT8)
(BIT7)
(BIT6)
(BIT5)
(BIT4)
(BIT3)
(BIT2)
(BIT1)
image signals to source driver
(SDATA8)
(SDATA7)
(SDATA6)
(SDATA5)
(SDATA4)
(SDATA3)
(SDATA2)
(SDATA1)
control signal
control signal
SCLK
SSP
226
timing control circuit
20 :signal processingcircuit
HSYNC(horizontal synchronizing signal)
VSYNC(vertical synchronizing signal)
CLOCK (synchronizing clock)
parallel transforming circuit
source driver 1
source driver 2
source driver 8
11
21
81
output 1
output 128
output 129
output 256
output 897
output 1024

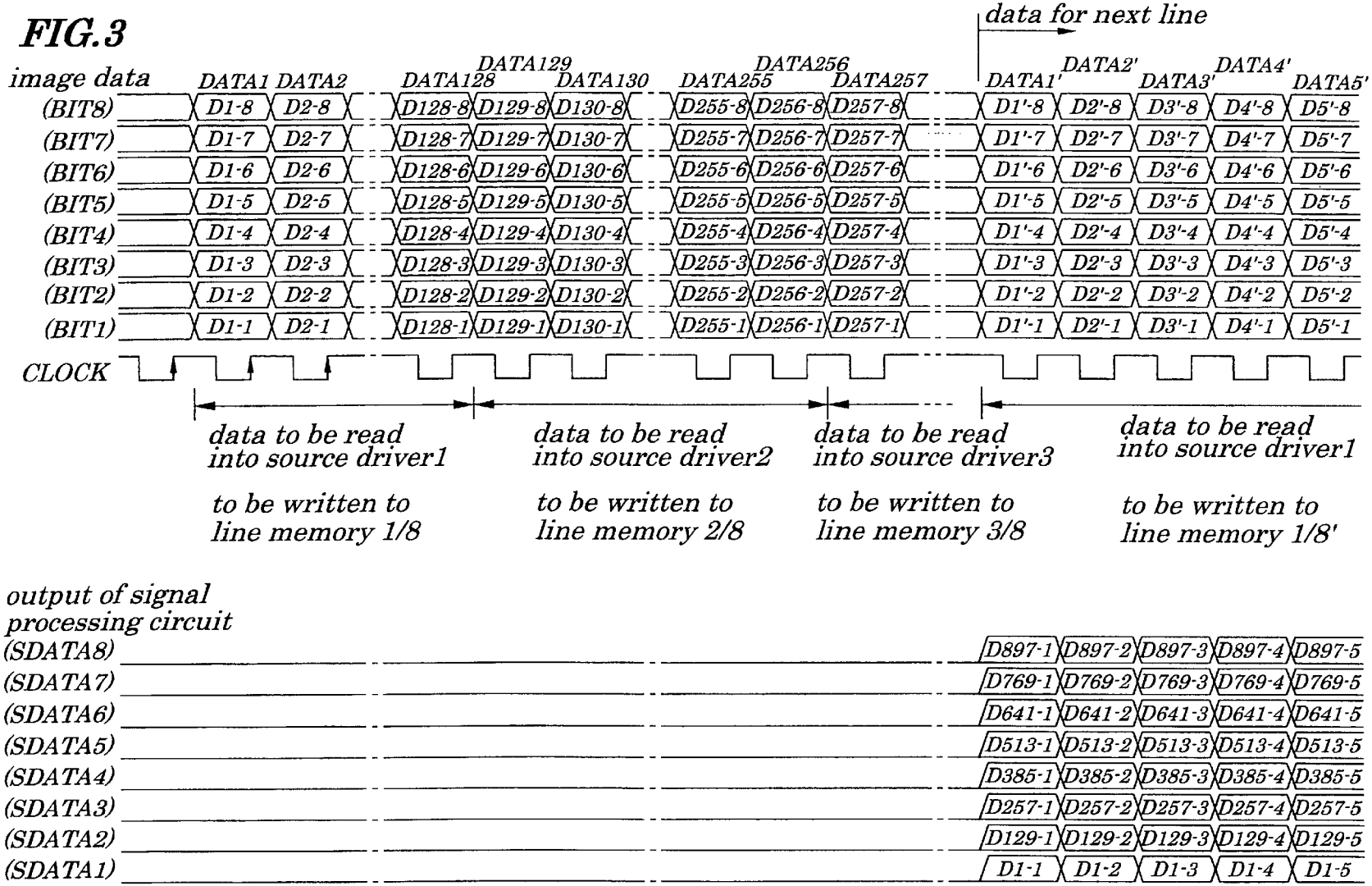
FIG.3
image data
(BIT8)
(BIT7)
(BIT6)
(BIT5)
(BIT4)
(BIT3)
(BIT2)
(BIT1)
CLOCK
DATA1 DATA2
DATA128 DATA129
DATA130
DATA255 DATA256
DATA257
data for next line
DATA1' DATA2' DATA3' DATA4' DATA5'
data to be read into source driver1
to be written to line memory 1/8
data to be read into source driver2
to be written to line memory 2/8
data to be read into source driver3
to be written to line memory 3/8
data to be read into source driver1
to be written to line memory 1/8'
output of signal processing circuit
(SDATA8)
(SDATA7)
(SDATA6)
(SDATA5)
(SDATA4)
(SDATA3)
(SDATA2)
(SDATA1)

total length of wiring $\doteqdot \frac{0}{7}L+\frac{1}{7}L+\frac{2}{7}L+\frac{3}{7}L+\frac{4}{7}L+\frac{5}{7}L+\frac{6}{7}L+\frac{7}{7}L=4L$ total length of wiring $\doteqdot \frac{4}{7}L+\frac{3}{7}L+\frac{2}{7}L+\frac{1}{7}L+\frac{0}{7}L+\frac{1}{7}L+\frac{2}{7}L+\frac{3}{7}L \doteqdot 2.29L$

LIQUID CRYSTAL DISPLAY DEVICE AND METHOD FOR TRANSFERRING IMAGE DATA

BACKGROUND OF THE INVENTION

1. Field of the Invention

The present invention relates to technology of a flat panel display and more particularly to a liquid crystal display device to display image data inputted from external devices and a method for transferring the image data inputted from external devices to a displaying means.

2. Description of the Related Art

FIG. 9 is a schematic block diagram explaining functions of a conventional liquid crystal display device; FIG. 10 is a schematic circuit diagram showing one form of connections of each of source drivers of the conventional liquid crystal display device of FIG. 9; FIG. 11 is a timing chart explaining operations of the liquid display device of FIG. 9; and FIG. 12 is a view showing a form of wiring to a source driver in the conventional liquid crystal device in FIG. 9.

In a conventional liquid crystal display device as shown in FIG. 9, as wiring between a signal processing circuit and source drivers, a bus line is provided which has the number of bits being two times larger than that of image data inputted from external devices or being an integral multiple of the same. That is, in the past when the number of bits of image data inputted from external devices was as small as 4 or 6 and a source driver with multiple pins for outputting was not available and therefore many source drivers were required, it was necessary to provide such bus lines to which source drivers were connected.

Japanese Laid-open Patent Application No. Hei 6-45508 discloses such a display device as has configurations described above (hereafter as a "first conventional display device"). The first conventional display device is comprised of a board, two or more semiconductor driving circuits mounted on the board, two or more first bonding pads used to feed a clock signal to the semiconductor driving circuits, which are disposed in the vicinity of each of the semiconductor driving circuits on the board, two or more second bonding pads used to feed a data signal to the semiconductor driving circuits, which are disposed in the vicinity of each of the semiconductor driving circuits on the board, two or more clock signal lines disposed on the board and connected to the first bonding pads and two or more data signal lines disposed on the board and connected to the second bonding pads. Two or more data signal lines may contain both a first line to connect the second bonding pads to each other and a second line to feed the data signal to the first line, or may be connected to each of the first bonding pads.

The semiconductor driving circuits may be comprised of a discrete semiconductor device such as a transistor or a discrete semiconductor component, or of integrated circuits (IC) into which many semiconductors are integrated. In the first conventional display device, since the clock signal can be fed separately to the semiconductor driving circuits through the clock signal line and the first bonding pad, by supplying the clock signal with staggered timing for every semiconductor driving circuit, a data signal can be fed independently to each of the semiconductor driving circuits. Unlike in the case of a fluorescent display panel, bonding pads and signal lines used to output a data signal are not required, thus allowing the reduction in the number of bonding pads. As a result, the wiring density around the driving circuits can be reduced. It is also reported in the description of the disclosed display device that, since adequate distance between the driving circuit and the bonding pad can be maintained owing to the reduction in the wiring density, the reliability required when they are wire-bonded is more improved compared with the conventional fluorescent display panel.

Japanese Laid-open Patent Application No. Hei6-148665 discloses another example of a conventional display device (hereafter as a "second conventional display device"). The second conventional display device is provided with two or more driving circuit devices mounted on a glass board, groups of wiring for inputting and outputting to and from these driving circuit devices and terminal areas for inputting from external devices. The wiring groups for inputting provided at the inputting terminal areas are divided into two groups, one to be used in common by the driving circuit devices and the other to be used independently by each of the driving circuit devices. In the second conventional display device, though impedance of the inputting wiring has an influence on displaying characteristics of the liquid crystal device, it does not mean that all wiring is affected equally and the degree of the influence varies depending on the use of the wiring. The wiring group being affected little by the impedance is separated from that being much affected by the same. The wiring group being affected little is so configured that power is supplied through a bus line from one terminal for external input to each of driving circuit devices and the wiring group being affected much is so configured that power is supplied independently to each of driving circuit devices. The use of the wiring designed specifically for the wiring group being affected much allows the impedance to be lowered and excellent display characteristics to be obtained. In addition, the wiring group being affected little is connected by the bus line, thus preventing the number of input terminal areas being increased.

However, in recent years when the number of bits of image data and the transfer speed of the image data are increased, since a transfer frequency of the bus line and operational frequency of the source driver in the first and second conventional display devices have their own upper limit, it is necessary that the number of bits of the bus line be an integral multiple of that of the image data. This causes increased area occupied by wiring on the printed board and increased number of the lines for wiring, thus inducing increased noise influences due to EMI (electromagnetic interference).

SUMMARY OF THE INVENTION

In view of the above, it is an object of the present invention to provide a liquid crystal display device and a method for transferring image data wherein the length of wiring connected between a signal processing circuit and each of source drivers can be reduced and EMI caused by through holes can be prevented, thus improving anti-electromagnetic interference characteristics.

According to a first aspect of the present invention, there is provided a liquid crystal display device for displaying image data inputted from external devices comprising:

- a means to split one display line of the image data in accordance with the number of source drivers used to drive a displaying means;
- a means to read, in serial, each of the split blocks of the image data and to transform the read image data in unit of dots into image data in serial form;
- a means to transfer, in serial, the image data transformed to serial form, with each of the split blocks of the image data being associated with each of the source drivers in a one-to-one state;

a means to transform the image data in serial form serially transferred to each of the source drivers to image data having a specified bit length in parallel form and to produce it;

a means to combine the image data in parallel form transferred from each of the source drivers in accordance with the arrangement of the source drivers and to restore one display line of the image data; and a means to transfer, in parallel, one display line of the restored image data to the displaying means to display it.

According to a second aspect of the present invention, there is provided a liquid crystal display device for displaying image data inputted from external devices comprising:

a signal processing circuit to split one display line of the image data in accordance with the number of source drivers used to drive a displaying means, to transform each of the split blocks of the image data to image data in serial form, and transfer, in serial, the image data transformed to serial form, with each of the split blocks of the image data being associated with each of the source drivers in a one-to-one state;

whereby the above two or more source drivers are connected, in parallel, to the signal processing circuit and transform the image data in serial form transferred in serial thereto to image data having a specified bit length in parallel form and produce it; and the displaying means restores one display line of the image data by combining the image data in parallel form transferred from each of the source drivers in accordance with the arrangement of the source drivers and displays one display line of the restored image data transferred in parallel thereto.

In the foregoing, a preferable mode is one wherein the signal processing circuit has two or more line memories used to split one display line of the image data into the number of blocks of the image data in accordance with the number of source drivers used to drive the displaying means.

Also, a preferable mode is one wherein the signal processing circuit has a serial transforming circuit provided in a state of being associated with each of the split blocks of the image data in a one-to-one relationship, which is used to transform each of the split blocks of the image data stored in each of the line memories to the image data in serial form in a state of being associated with each of the split blocks of the image data.

Also, a preferable mode is one wherein the serial transforming circuit transfers, in serial, the image data transformed to serial form with each of the split blocks of the image data being associated with each of the source drivers in a one-to-one state.

Furthermore, a preferable mode is one wherein each of the source drivers has a parallel transforming circuit connected to the serial transforming circuit in a one-to-one state and which is used to transform the image data transferred in serial to each of the source drivers to image data having a specified bit length in parallel form and to produce it.

According to a third aspect of the present invention, there is provided a method for transferring image data inputted from external devices to a displaying means comprising steps of:

splitting one display line of the image data in accordance with the number of source drivers used to drive the displaying means;

transforming each of the split blocks of the image data into image data in parallel form;

transferring the image data transformed to serial form with each of the split blocks of the image data being associated with each of the source drivers in a one-to-one state;

transforming the image data in serial form transferred in serial to each of the source drivers into image data having a specified bit length in parallel form to produce it;

restoring one display line of the image data by combining the image data in parallel form produced in previous steps in accordance with the arrangement of the source drivers; and transferring, in parallel, one display line of the restored image data to the displaying means.

According to a fourth aspect of the present invention, there is provided a method for transferring image data inputted from external devices to a displaying means comprising steps of:

processing signals to split one display line of the image data in accordance with the number of source drivers used to drive the displaying device, to transform each of the split blocks of the image data into image data in serial form and to transfer, in serial, image data transformed into serial form with each of the split blocks of the image data being associated with each of source drivers in a one-to-one state;

transforming, through the use of the source drivers, the image data in serial form transferred in serial to each of source drivers into image data having a specified bit length in parallel form to produce it;

restoring one display line of the image data by combining the image data in parallel form transferred from the source drivers in accordance with the arrangement of the source drivers; and displaying one display line of the restored image data transferred in parallel to the displaying means.

In the foregoing, it is preferable that the above step of processing signals contains a step of splitting one display line of the image data in accordance with the number of the source drivers used to drive the displaying means and of storing the split image data into a memory.

Also, it is preferable that the above step of processing signals includes a step of transforming each of the split blocks of the image data stored by the storing steps, with each of storing processes being associated with each of the split blocks of the image data in a one-to-one state, to image data in serial form with each of transforming processes being associated with each of the split blocks of the image data.

Also, it is preferable that the above step of transforming the image data includes a step of transferring, in serial, the image data transformed into serial form with each of the split blocks of the image data being associated with each of the source drivers in a one-to-one state.

Furthermore, it is preferable that the above step of transforming through the use of the source drivers includes a step of transforming the image data into serial form transferred in serial, to each of source drivers, with each of the serial transforming steps being associated with each of transferring processes in a one-to-one state, to image data having a specified bit length in parallel form to produce it.

BRIEF DESCRIPTION OF THE DRAWINGS

The above and other objects, advantages and features of the present invention will be more apparent from the following description taken in conjunction with the accompanying drawings in which:

FIG. 1 is a schematic block diagram showing functions of a liquid crystal display device to implement a method for transferring image data according to an embodiment of the present invention;

FIG. 2 is a schematic circuit diagram showing one form of connections between a signal processing circuit and source drivers of the liquid crystal display device of FIG. 1;

FIG. 3 is a timing chart explaining operations of the liquid crystal device of FIG. 1;

DETAILED DESCRIPTION OF THE PREFERRED EMBODIMENT

Best modes of carrying out the present invention will be described in further detail using one embodiment with reference to the accompanying drawings.

Figure 6:
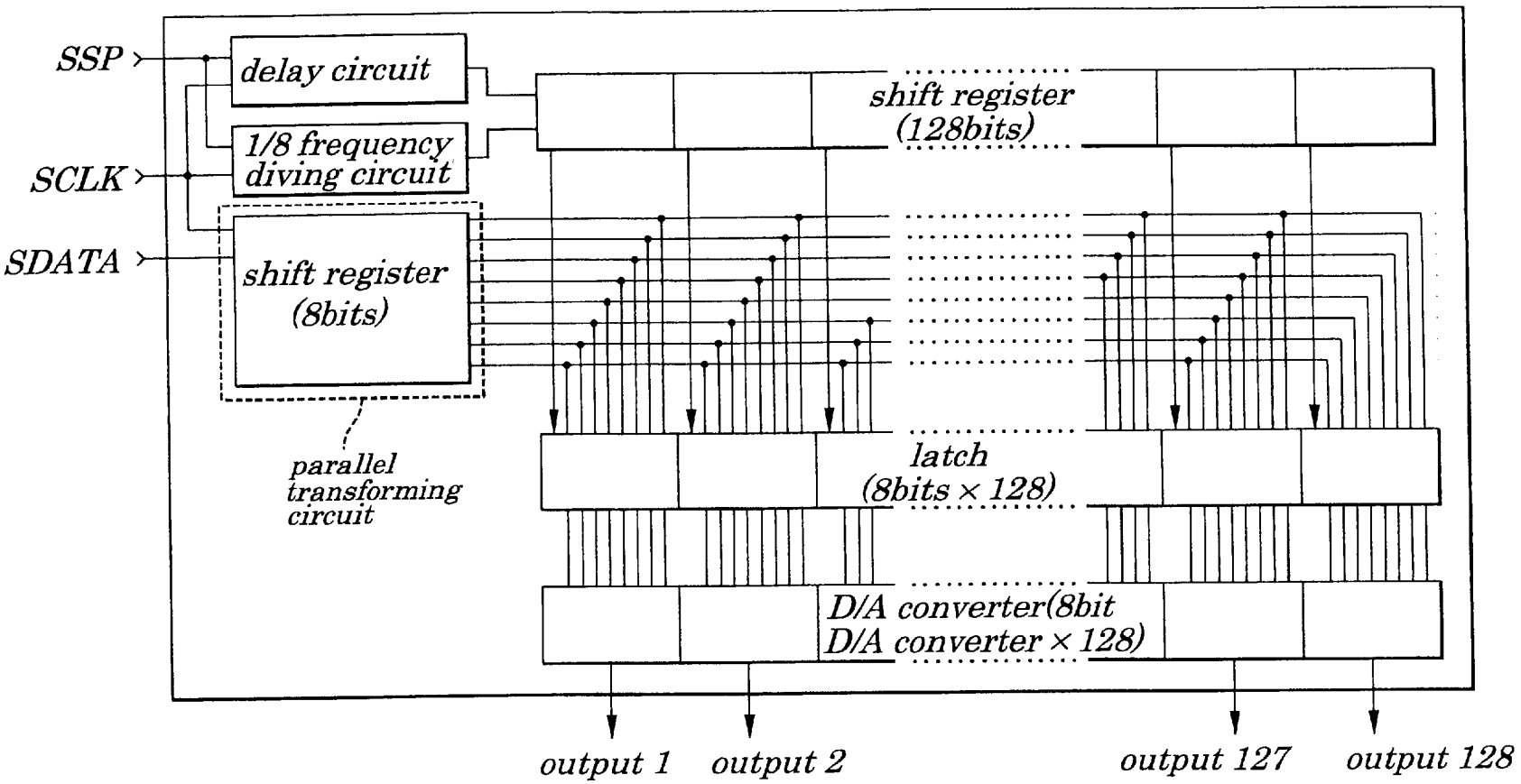
FIG. 6 is a schematic block diagram showing one form of the source driver used in the liquid crystal device in FIG. 1.

FIG. 1 is a schematic block diagram explaining functions of a liquid crystal display device to implement a method for transferring image data according to a first embodiment of the present invention. FIG. 2 is a schematic circuit diagram showing one form of connections between a signal processing circuit and source drivers of the liquid crystal display device of FIG. 1. As shown in FIGS. 1 and 2, according to this embodiment, the signal processing circuit 20 of the liquid crystal display device 10 is provided with two or more line memories 222 and 224 having storage capacity being able to store one display line of image data (i.e., 1024 dots, each dot being composed of 8 bits) and serial transforming circuits 501 to 508 each corresponding to each of source drivers 1 to 8. The image data inputted to the liquid crystal display device 10 is stored in the first memory 222. After one display line (1024 dots) of the image data is accumulated in the first line memory 222, the accumulated image data is split into the number of source drivers (8). Each of the split image data (1024/8=128 dots) is transformed to the image data in serial form and transferred in serial to each of the source drivers 1 to 8. In the parallel transforming circuits 11 to 81 mounted within the source drivers 1 to 8, the image data (128 bits×8=1024 bits) is restored to image data in parallel form and, after being split into 8 portions in a unit of 256 bits, is transferred in parallel to a liquid crystal panel 30. On the other hand, a subsequent display line of image data (1024 dots) is stored in the second line memory 224. After one display line of the image data (1024 dots) is accumulated in the second line memory 224, the image data accumulated in the second line is split into the number of source drivers (8). Each of the split image data (1024/8=128 dots) is transformed to image data in serial form in units of dots (one dot is composed of 8 bits in this example) and transferred to each of the source drivers 1 to 8. In the parallel transforming circuits 11 to 81 mounted within the source drivers 1 to 8 (A schematic block diagram of the source drivers is shown in FIG. 6; after each of dot data is restored to 8-bit image data in parallel form, the restored data is expanded by shift registers and latches in the direction of a line and is then transferred to the liquid crystal panel 30. In the case of the parallel transformation as in this embodiment, the image data in parallel form is outputted 8 clocks after the inputting of the image data has started and, therefore, a delay circuit mounted within the source driver is provided to delay a start of operations of the shift register and the latch used to expand the image data in the direction of a line. A 1/8 frequency dividing circuit is provided because the image data in parallel form is outputted in every 8 clocks from the parallel transforming circuits.

The liquid crystal display device 10 of this embodiment is assumed to be a device which displays image data of R (Red), G (Green) and B (Blue) colors each being composed of 8 bits. The liquid crystal display device 10 is comprised mainly of the liquid crystal panel 30, the signal processing circuit 20, the source drivers 1 to 8 having the parallel transforming circuits 11 to 81, gate drivers 402 to 408 adapted to start their operations in response to a gate-driver start pulse GSP produced using signals VSYNC and HSYNC inputted from external devices such as a computer or the like and to be operated in synchronization with a gate driver clock GCLK. According to this embodiment, a method is employed by which dot image data is transferred, after being further transformed into image data in serial form, from the signal processing circuit 20 to the source drivers 1 to 8.

In response to a synchronizing clock CLOCK, a horizontal synchronizing signal HSYNC and a vertical synchronizing signal VSYNC each being inputted from external devices such as personal computers or the like, the image data of the R, G and B colors each being composed of 8 bits are stored by the signal processing circuit 20 into the first line memory 222 and, after one display line of the image data is accumulated, the accumulated data is split into the number of the source drivers and, after being transformed into image data in serial form, is transferred in serial to each of the source drivers 1 to 8. Preferably, the number of source drivers is equal to the number of bits of the image data or of the source drivers 1 to 8. For example, if the image data of the R, G and B colors each being composed of 8 bits, the number of source drivers is preferably 8.

When one display line of subsequent image data (1024 dots) is inputted, it is stored into a second line memory 224.

In the case of the example shown in FIG. 1, the image data of the R, G and B colors each being composed of 2 bits are transformed into image data SDATA 1 to 8 in serial form.

In addition, the number of bits of the image data SDATA 1 to 8 (i.e., the number of bits which is transferred at the same time) is determined by dividing a transfer speed by a present upper limit value of operational frequency of each of the source drivers 1 to 8.

In response to a source-driver start pulse SSP, the source drivers 1 to 8 start to receive the image data, which has been transformed into image data in serial form, outputted from the signal processing circuit 20. Each of the image data SDATA 1 to 8 is inputted, in synchronization with a source-driver clock SCLK, to each of corresponding source drivers 1 to 8, where the image data is transformed into image data in parallel form and is used as an image data for driving the liquid crystal panel 30.

By such configurations, wiring between the signal processing circuit 20 and each of the source drivers 1 to 8 is established in a one-to-one state. This means that the liquid crystal display device 10 is so configured that the source drivers 1 to 8 are arranged in a straight line. If the number of lines for outputting from the signal processing circuit can remain the same and if the wiring to the source drivers 1 to 8 can be established in a one-to-one state, the total wiring for transferring the image data to each of the source drivers 1 to 8 can be decreased in length.

Moreover, if the number of lines to the source drivers 1 to 8 of this embodiment is the same as that used in the conventional method, the image data can be transferred at the same frequency in both cases. Therefore, if the total wiring for transferring the image data can decrease in length, the EMI can be reduced effectively.

By referring to FIG. 2, one form of connections between the signal processing circuit and corresponding source drivers of the liquid crystal display device is described. Ordinarily, the image data to be applied to this display device of this embodiment is comprised of three systems of colors including the R, G and B colors. To simplify the description, the image data containing one system of the color is shown in FIG. 2.

According to this embodiment, one image data is composed of 8 bits (Bit 1, . . . , and Bit 8). The source drivers to drive the liquid crystal panel 30 is comprised of 8 source drivers (1 to 8) which are used to drive the liquid crystal panel 30 having 1024 dots in a horizontal direction.

The signal processing circuit 20 is comprised of a first line memory 222 containing memory areas 1/8 to 8/8 (being comprised of 8 bits in total) and a second line memory 224 containing memory areas 1/8' to 8/8' (being comprised of 8 bits in total).

The timing control circuit 226 is adapted to produce control signals to be fed to the first line memory 222 and second line memory 224 and a source-driver start pulse SSP or source-driver clock signal SCLK to be fed to source drivers 1 to 8, in response to a synchronizing clock CLOCK, a horizontal synchronizing signal HSYNC and a vertical synchronizing signal VSYNC outputted from external devices such as computers or the like.

The memory area 1/8 of the first line memory 222 and the memory area 1/8' of the second memory 224 are storage areas to store the image data to be written to the source driver 1. The memory area 2/8 of the first line memory 222 and the memory area 2/8' of the second line memory 224 are storage areas to store the image data to be written to the source driver 2.

To correspond to 8 pieces of the source drivers (1 to 8), the first line memory is composed of 8 pieces of memory areas (1/8 to 8/8) (being comprised of 8 bits in total). Similarly, the second line memory is composed of 8 pieces of memory areas (1/8' to 8/8'). Since one image data is composed of 8 bits and the number of dots to be outputted from the source drivers (1 to 8) is 128, the number of bits of 8 pieces of memory areas (1/8 to 8/8) of the first line memory 222 is 1024 (8×128) and the number of bits of 8 pieces of memory area (1/8' to 8/8') of the second line memory 224 is 1024 as well.

The inputting and outputting of the memory areas 1/8 to 8/8 (being comprised of 8 bits) of the first line memory 222 and the memory areas 1/8' to 8/8' (being comprised of 8 bits) of the second line memory 224 are switched for every display line of the image data; that is, while the image data is being written to each of the memory areas 1/8 to 8/8 of the first line memory 222, the image data (8 bits of data) is outputted from each of the memory areas 1/8' to 8/8' of the second line memory 224. On the other hand, while the image data is being written to each of the memory areas 1/8' to 8/8' of the second line memory 224, the image data (8 bits of data) is outputted from each of the memory areas 1/8 to 8/8 of the first line memory 222.

The image data outputted from the first line memory 222 with each of the image data being allocated to each of the source drivers 1 to 8, after being transformed to SDATA 1 to 8 by the serial transforming circuits mounted within the signal processing circuit 20, is transferred in serial to each of the source drivers 1 to 8.

The source drivers 1 to 8 are provided with parallel transforming circuits 11 to 81 used to restore the image data (each being composed of 1024 dots) transformed to SDATA 1 to 8 in serial form into the image data in parallel form. Each of the parallel transforming circuits 11 to 81 can output 128 bits of data in parallel.

The timing control circuit 226 is used to control the timing for reading and writing the image data to and from the first line memory 222 and the switching of the first line memory and, further to control the serial transforming circuits 501 to 508 and the drivers in response to a synchronizing clock CLOCK, horizontal synchronizing signal HSYNC and vertical synchronizing signal VSYNC inputted from external devices such as personal computers or the like.

Next, operations of the liquid crystal display device according to the embodiment by referring to FIG. 3 are described. FIG. 3 is a timing chart explaining operations of the liquid crystal device of FIG. 1.

According to the embodiment of the present invention, the image data are composed of 8 bits. The image data DATA 1 shown in FIG. 3 represents the 1st dot image data and DATA 2 represents the 2nd image data. The image data DATA 1 to 1024 are provided.

The image data, as 8-bit image data in parallel format (BIT1, . . . , and BIT8), are inputted to the signal processing circuit 20 in order of image data DATA1, DATA2, . . . , and DATA1024 and written to each of the memory regions 1/8 to 8/8 of the first line memory.

The signal processing circuit 20, after the completion of writing the image data to all memory areas 1 to 8 of the first line memory 222, starts writing the next display line of the image data (1024 dots) to the memory area 1/8' of the second line memory 224 sequentially.

The serial transforming circuit 501 connected to the memory area 1/8 of the first line memory 222 outputs the image data to the source driver 1 in order of BIT 1 to BIT 8 of the image data DATA1, BIT 1 to BIT8 of DATA2, . . . , and BIT1 to BIT8 of DATA128. The serial transforming circuit 502 connected to the memory area 2/8 of the first line memory 222 outputs the image data to the source driver 2 in order of BIT 1 to BIT 8 of the image data DATA129, BIT 1 to BIT8 of DATA130, . . . , and BIT1 to BIT8 of DATA256. In the same manner, the serial transforming circuit 508 connected to the memory area 8/8 of the first line memory 222 outputs the image data to the source driver 8 in order of BIT 1 to BIT 8 of the image data DATA897, BIT 1 to BIT8 of DATA898, . . . , and BIT1 to BIT8 of DATA1024.

The serial transforming circuit 501 connected to the memory area 1/8' of the second line memory 224 outputs the image data to the source driver 1 in order of BIT 1 to BIT 8 of the image data DATA1, BIT 1 to BIT8 of DATA2, . . . , and BIT1 to BIT8 of DATA128. On the other hand, the serial transforming circuit 502 connected to the memory area 2/8' of the second line memory 224 outputs the image data to the source driver 2 in order of BIT 1 to BIT 8 of the image data DATA129, BIT 1 to BIT8 of DATA130, . . . , and BITl to BIT8 of DATA256. In the same manner, the serial transforming circuit 508 connected to the memory area 8/8' of the second line memory 224 outputs the image data to the source driver 8 in order of BIT 1 to BIT 8 of the image data DATA897, BIT 1 to BIT8 of DATA898, . . . , and BIT1 to BIT8 of DATA1024.

Moreover, according to the embodiment, there is no limitation to the order of outputting of the image data and to the order of a least significant bit (LSB) and most significant bit (MSB).

The serial transforming circuit 501 transforms the image data into the image data SDATA1 in serial form and transfers it sequentially to the source driver 1 and then the parallel transforming circuit 11 mounted within the source driver 1 restores the transferred image data to one dot of image data composed of 8 bits in parallel form and allots 128 dots of the image data to each of outputs (1 to 128). The serial transforming circuit 502 transforms the image data into the image data SDATA2 in serial form and transfers it sequentially to the source driver 2 and then the parallel transforming circuit 21 mounted within the source driver 2 restores the transferred image data to 128 dots of image data (outputs 129 to 255) in parallel form. In the same manner, the serial transforming circuit 508 transforms the image data into the image data SDATA8 in serial form and transfers it sequentially to the source driver 8 and then the parallel transforming circuit 81 mounted within the source driver 8 restores the transferred image data to 128 dots of image data (outputs 897 to 1024) in parallel form.

The signal processing circuit 20 performs the same processing as above for the next display line and thereafter by alternately switching between the memory areas 1/8 to 8/8 (being composed of 8 bits) of the first line memory 222 and the memory areas 1/8' to 8/8' (being composed of 8 bits) of the second line memory 224 and then transfer the image data in serial to each of the source drivers 1 to 8.

Figure 4:
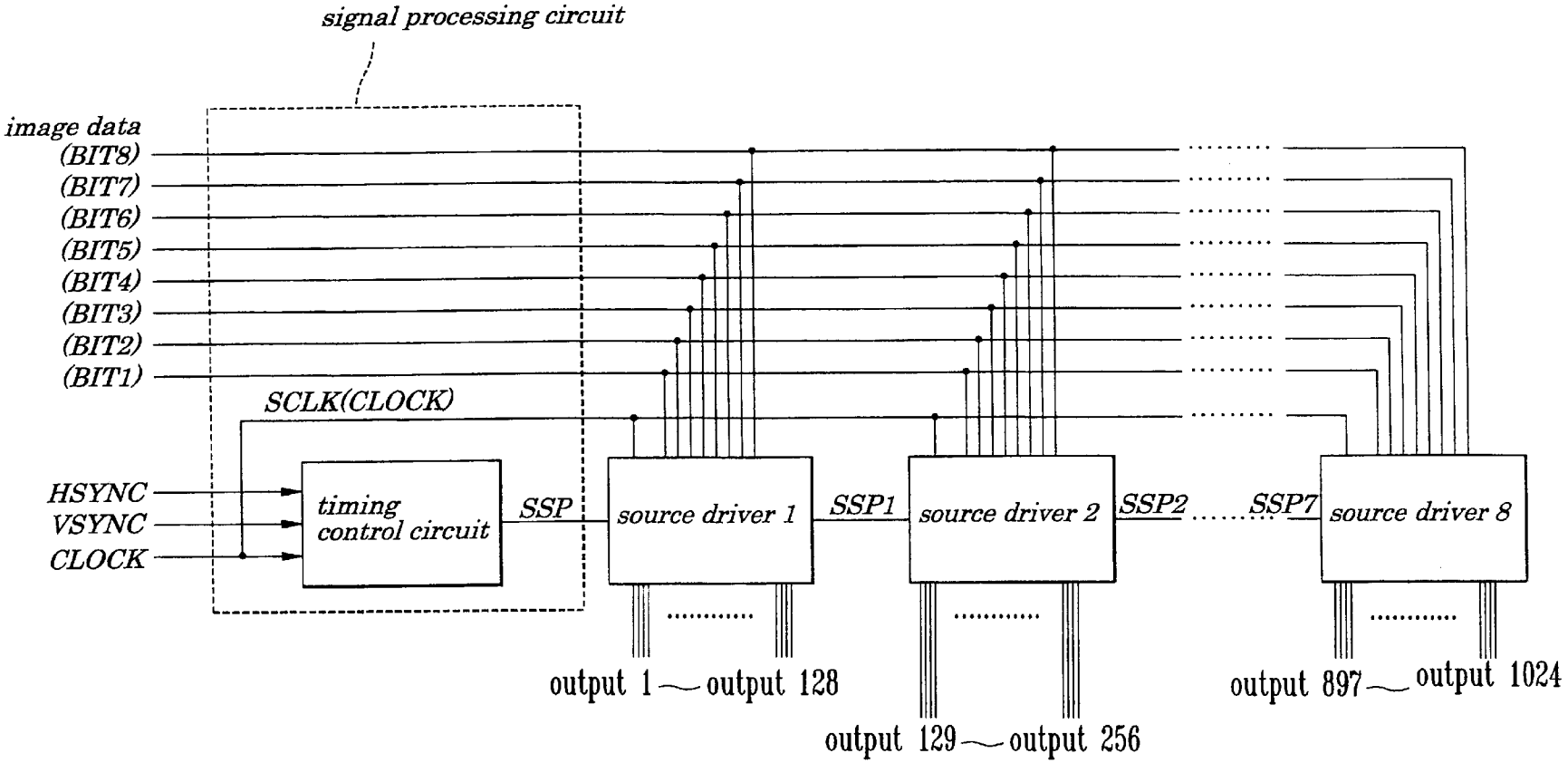
FIG. 4 is a schematic circuit diagram showing one form of connections between a signal processing circuit and source drivers of the conventional liquid crystal display device of FIG. 9.
Figure 9:
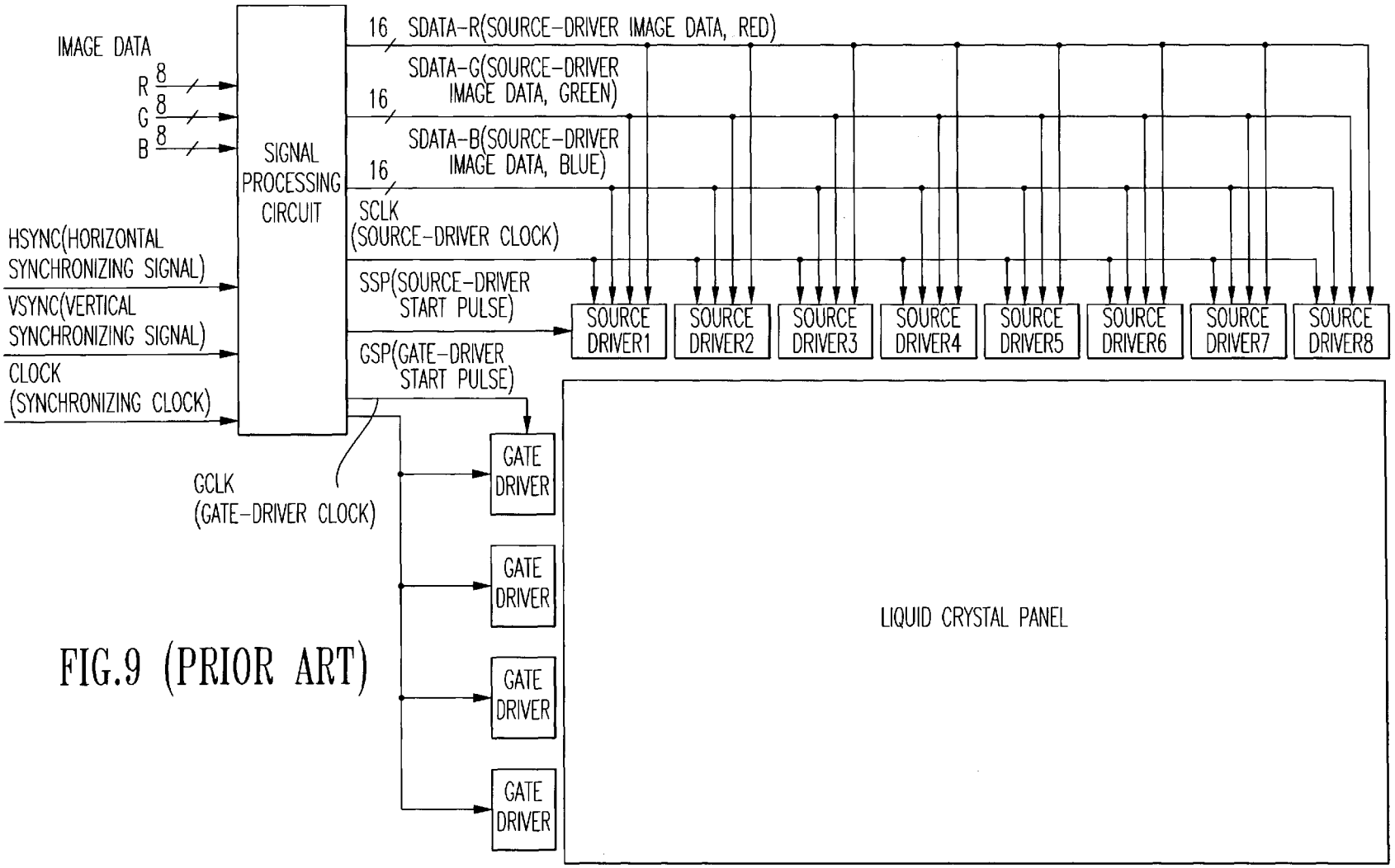
FIG.9 (PRIOR ART)
FIG. 9 is a schematic block diagram explaining functions of a conventional liquid crystal display device.
Figure 10:
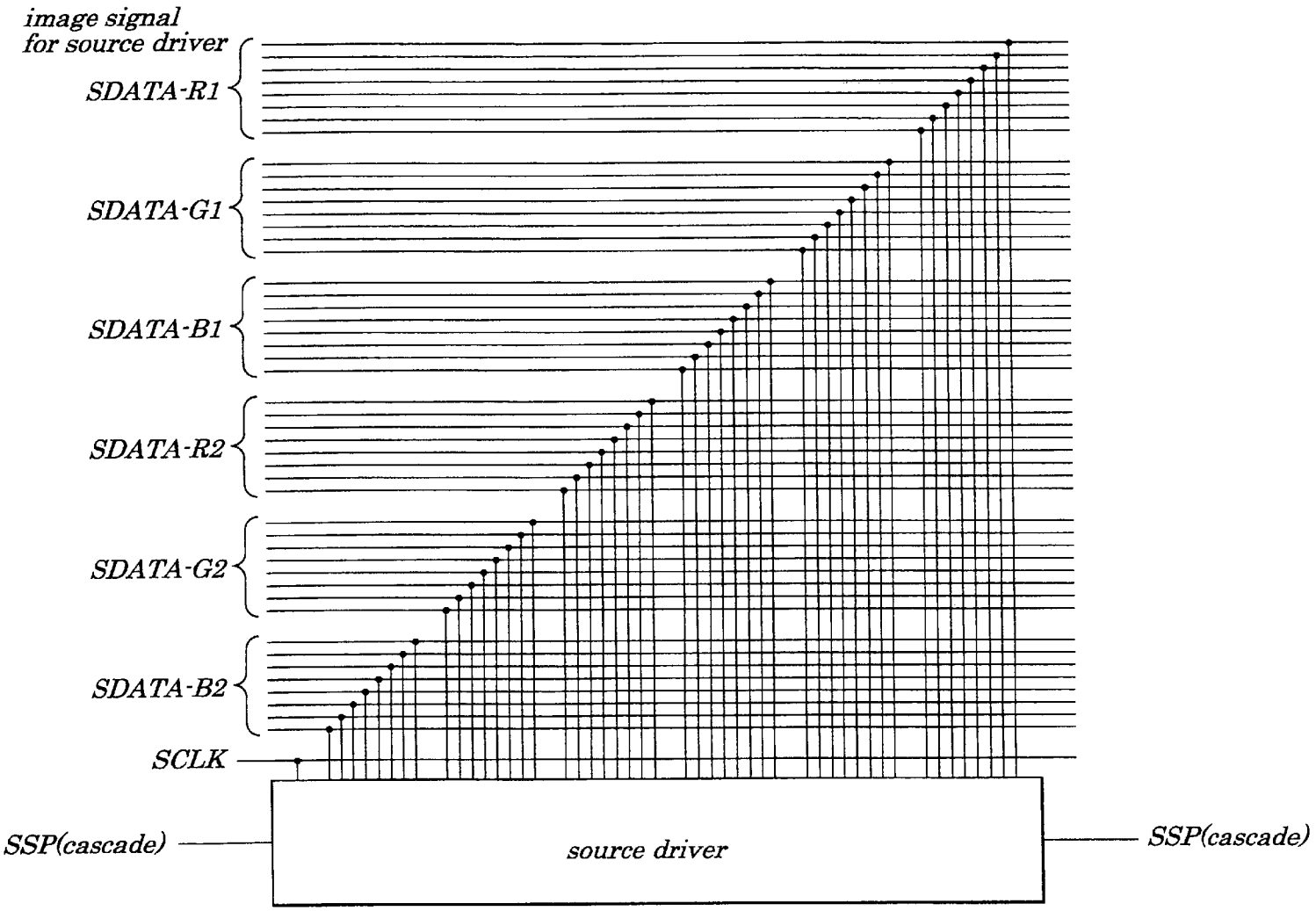
FIG. 10 (PRIOR ART)
FIG. 10 is a schematic circuit diagram showing one form of connections of each of source drivers of the conventional liquid crystal display device of FIG. 9.

FIG. 9 is a schematic block diagram explaining functions of a conventional liquid crystal display device. FIG. 4 is a schematic circuit diagram showing one form of connections between a signal processing circuit and source drivers of the conventional liquid crystal display device of FIG. 9. FIG. 10 is a schematic circuit diagram showing one form of connections of each of source drivers of the conventional liquid crystal display device of FIG. 9. The same reference numbers designate corresponding parts in configurations shown in the previous drawings.

In the conventional liquid crystal device as shown in FIG. 9, it is necessary to connect 48 pins to an input of each of the source drivers, requiring 48 lines for image data to connect the signal processing circuit to all the source drivers.

Figure 5:
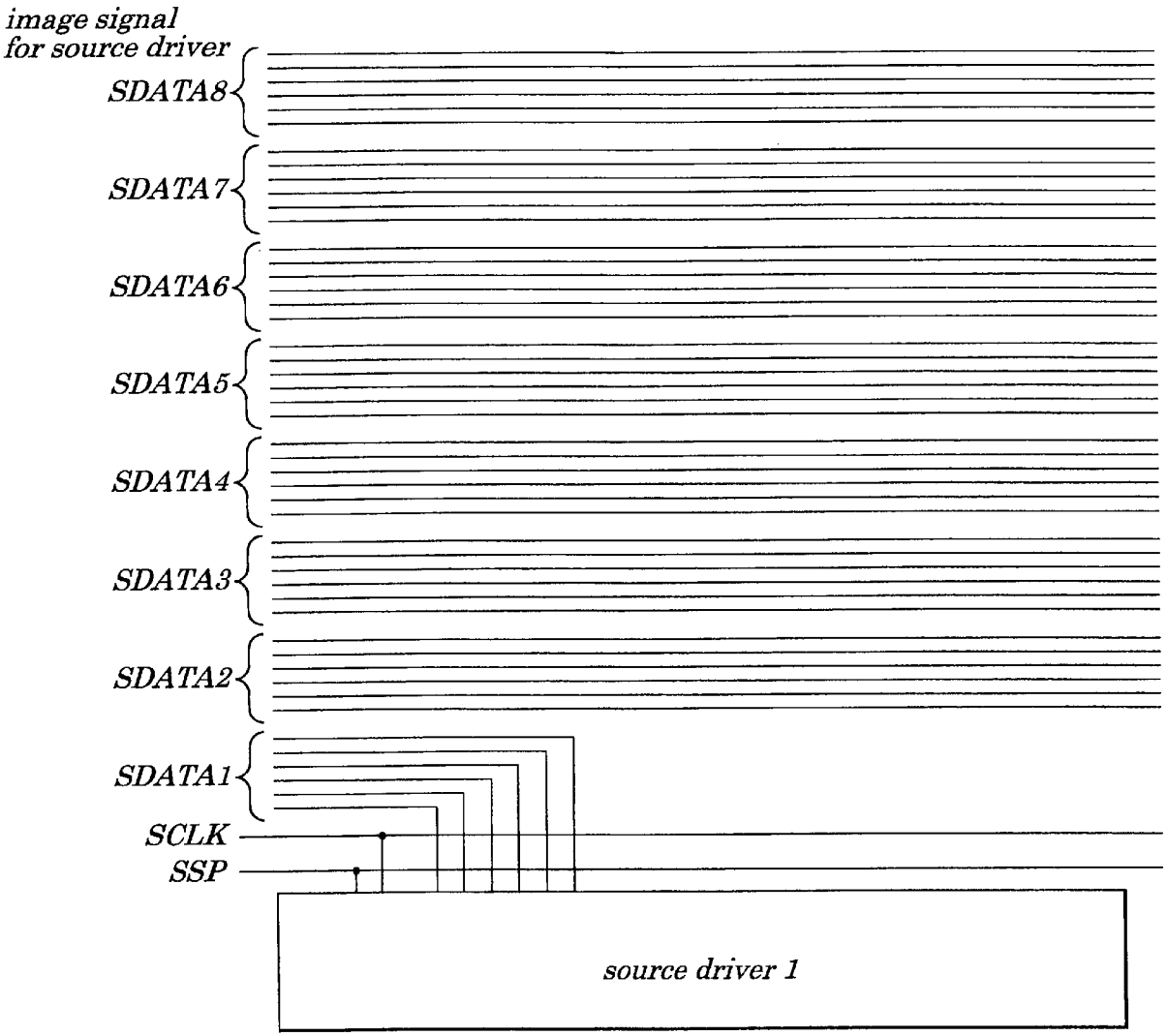
FIG. 5 is a schematic circuit diagram showing one form of connections of each of source drivers of the liquid crystal display device of FIG. 1.

FIG. 5 is a schematic circuit diagram showing one form of connections of each of source drivers 1 to 8 of the liquid crystal display device 10 of FIG. 1. According to the liquid crystal display device of the embodiment of the present invention, as shown in FIG. 5, though 48 lines for the image data are connected to the signal processing circuit 20, the line can be reduced per one source driver, thus decreasing the wiring in length by a half. Moreover, if the signal processing circuit 20 is disposed between the source drivers 4 and 6, the wiring of the whole liquid crystal display device 10 decreases further by a half in length. The wiring of the liquid crystal display device of the present invention is one-fourth shorter than that of the conventional liquid crystal display device shown in FIG. 9. This achieves a great reduction in the amount of the wiring of the liquid crystal display device of the present invention.

By reducing the amount of wiring through which a signal with high frequency such as image data passes, unwanted electromagnetic radiation causing EMI (electromagnetic interference) can be prevented easily. Furthermore, according to the present invention, since the wiring between the signal processing circuit 20 and each of the source drivers 1 to 8 can be established in a one-to-one state, countermeasures against EMI can be taken without taking into consideration effects on other source drivers.

On the other hand, in configurations of the conventional liquid crystal display device as shown in FIG. 9, as is apparent in FIG. 10, because the wiring is provided to all source drivers except the last one, the intersection of at least 47 signals occurs. That is, the conventional liquid crystal display device presents a problem in that it is necessary to provide 47 through holes corresponding to each of the source drivers on a printed board of the practical liquid crystal display device, thus making it difficult to reduce the area of the printed board. This leads to increased occurrence of EMI caused by the through holes. Thus, the present invention can solve these problems.

Figure 11:
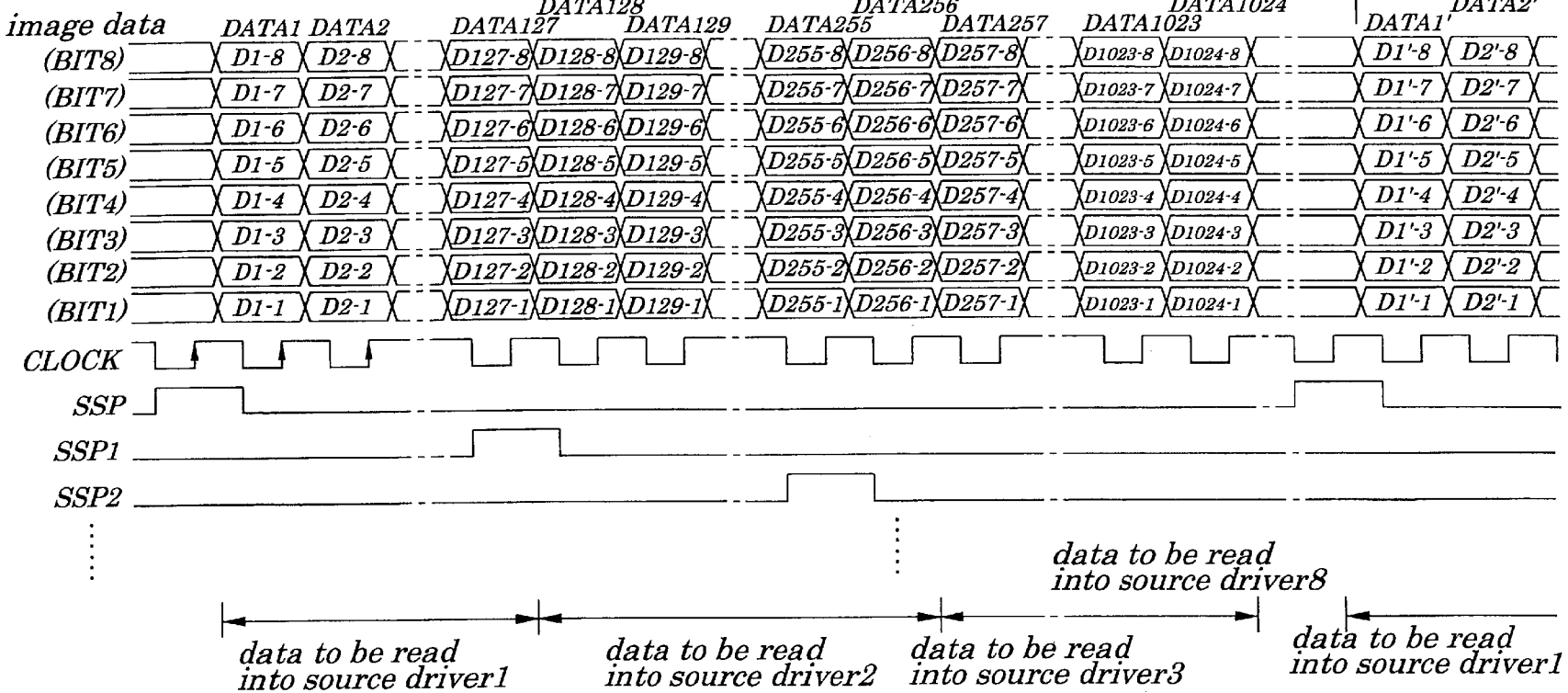
FIG.11 (PRIOR ART)
FIG. 11 is a timing chart explaining operations of the liquid display device of FIG. 9.
Figure 12:
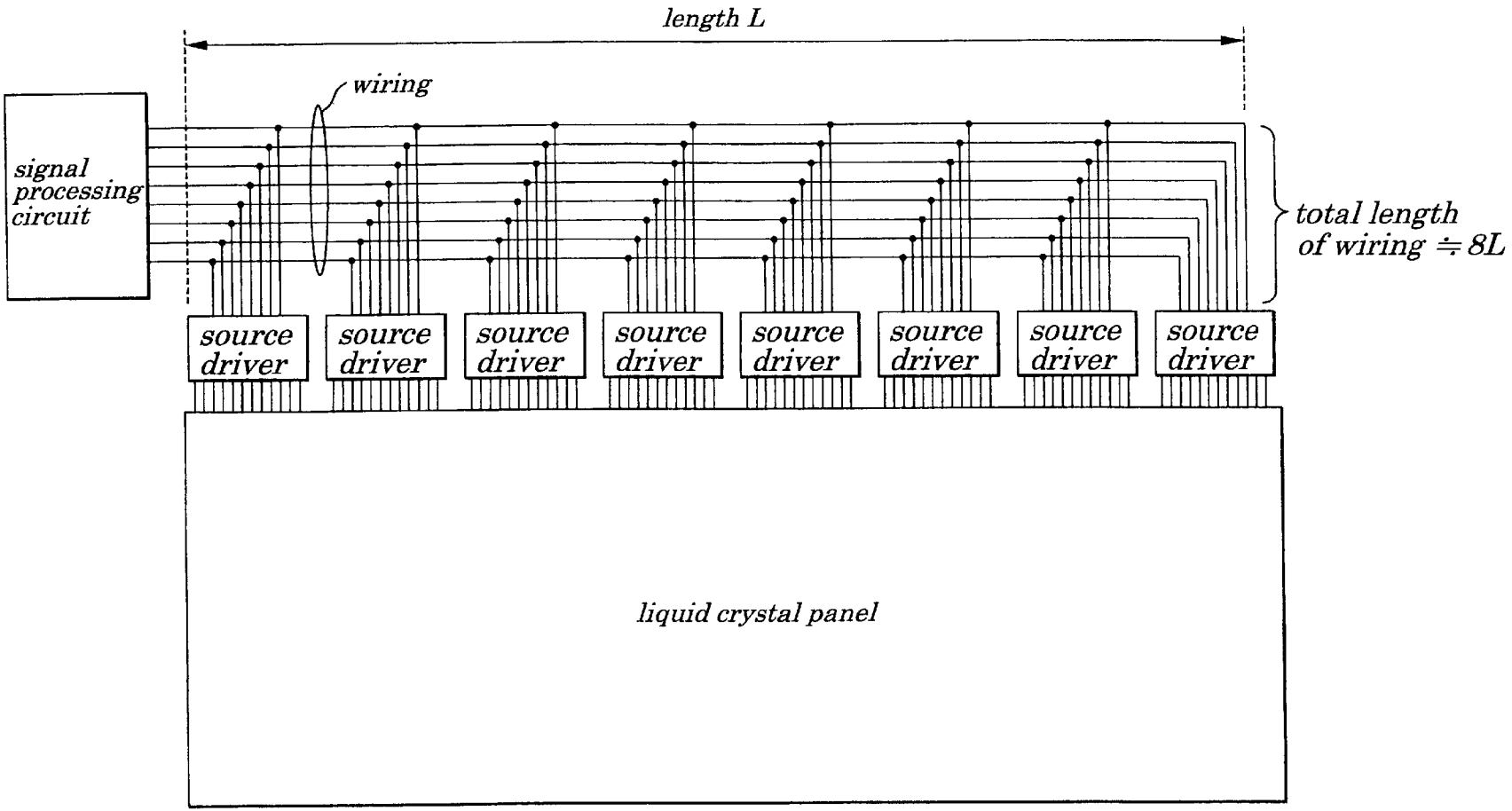
FIG. 12 (PRIOR ART)
FIG. 12 is a view showing a form of wiring to a source driver in the conventional liquid crystal device in FIG. 9.

FIG. 11 is a timing chart explaining operations of the conventional liquid display device of FIG. 9. As shown in FIG. 9, because the conventional liquid display device performs displaying operations using the image data in parallel form, it requires 48 input terminals for the source driver. According to the present invention, however, the number of input terminals for the source driver can be reduced owing to the introduction of the serial transformation; for example, in the embodiment of the present invention as shown in FIG. 1, it requires only 6 input terminals. As a result, the present invention makes it possible to ensure the connection of input terminals and to achieve the miniaturization of the source drivers 1 to 8.

Figure 7:
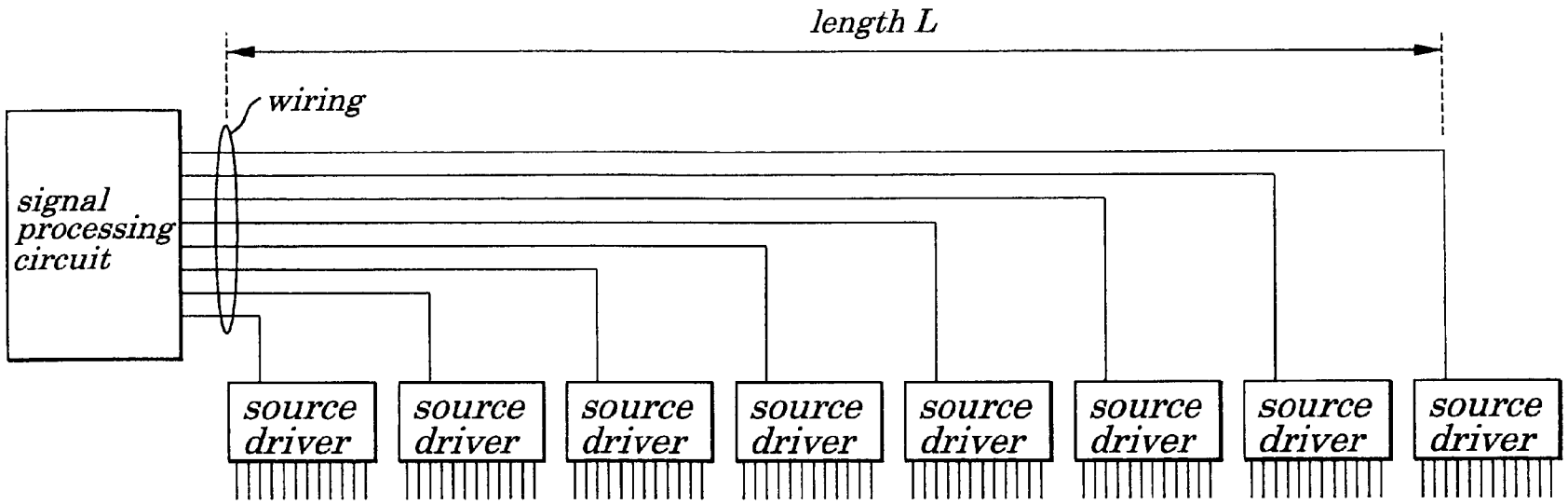
FIG. 7 is a view showing a form of wiring to a source driver of the present invention in FIG. 1.
Figure 8:
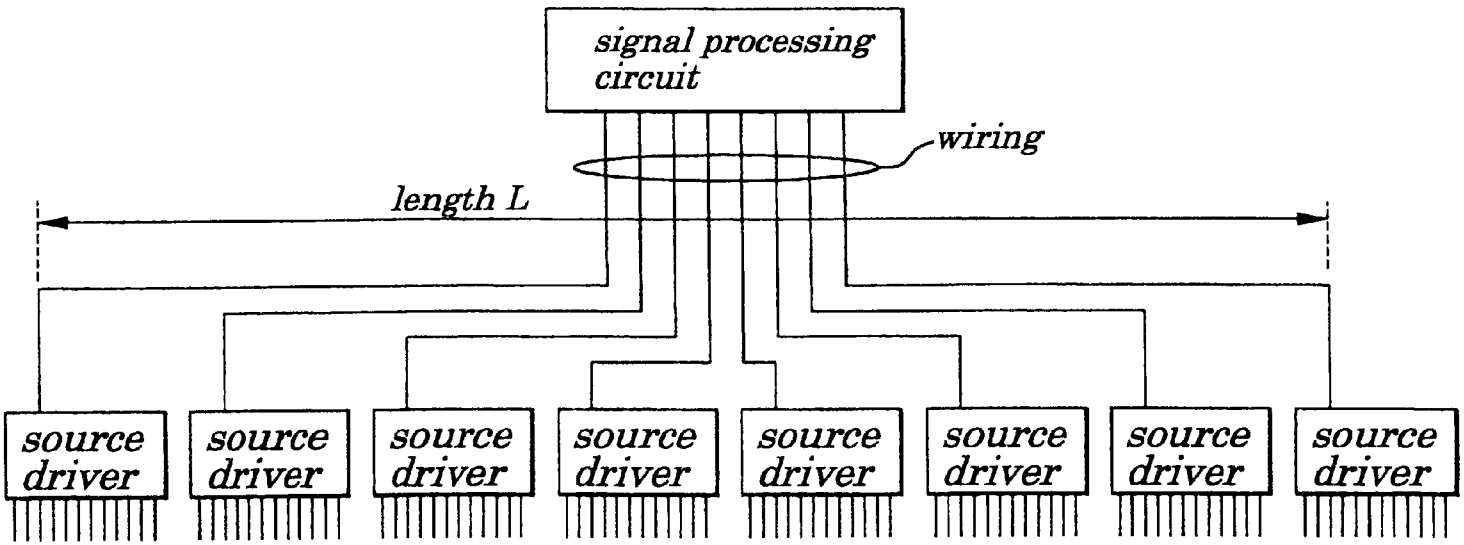
FIG. 8 is a view showing another form of wiring to the source driver of the present invention in FIG. 1.

The liquid crystal display device according to this embodiment of the present invention can be summarized as follows:

The signal processing circuit 20 of the liquid crystal display device of the present invention is provided with line memories 222 and 224 having storage capacity being able to store, at least, two display lines of image data and serial transforming circuits 501 to 508. One display line of the image data received by the signal processing circuit 20 is split into the number of source drivers (8). Each of the split image data, after being transformed into image data in serial form, is transferred in serial to each of the source drivers 1 to 8. The image data transferred in serial after being transformed into image data in serial form is restored to image data in parallel form by each of the source drivers 1 to 8 and, after being split into 8 portions in a unit of 128 dots, is transferred in parallel to the liquid crystal panel 30. As a result, in such a display device as the liquid crystal display device 10 in particular, in which a position of each of the source drivers 1 to 8 is naturally determined depending on the size of the liquid crystal panel 30, it is made possible to reduce the length of the wiring for connections between the signal processing circuit 20 and source drivers 1 to 8 in the whole liquid crystal display device 10 by approximately one-half (the total length being 4 L in FIG. 7) to one fourth (the total length being 2.29 L in FIG. 8) compared with that (the total length being about 8 L) in the conventional liquid crystal display device.

As described above, in the present invention, by reducing the amount of wiring through which a signal with high frequency such as image data passes, unwanted electromagnetic radiation causing EMI (electromagnetic interference) can be prevented easily. Furthermore, since the wiring between the signal processing circuit and each of the source drivers can be established in a one-to-one state, countermeasures against the EMI can be taken without taking into consideration effects on other source drivers.

Also, in accordance with the present invention, it is not necessary to provide many through holes corresponding to each of the source drivers on the printed board of the practical liquid crystal display device. As a result, it is possible to reduce the area of the printed board, thus avoiding increased occurrence of the EMI caused by the through holes and, as a result, improving anti-electromagnetic interference characteristics.

It is apparent that the present invention is not limited to the above embodiment but may be changed and modified without departing from the scope and spirit of the invention. For example, the present invention is not limited to such liquid crystal display devices only but is also applied to such flat panel display devices as the position of the source driver is determined depending on the size of the liquid crystal panel including a plasma display, EL (Electro-luminescence) display, FED (Field Emission Display) and the like. Additionally, the number, position, shape or the like of constitutional components of the display device of the present invention is not limited to those shown in the above embodiment but any number, position and shape may be used so long as they are suitable for carrying out the present invention.

Finally, the present application claims the priority based on Japanese Patent Application No. Hei10-344855 filed on Nov. 19, 1998 which is herein incorporated by reference.

What is claimed is:

1. A liquid crystal display device that receives image data from external devices and displays said image data as a plurality of display lines on a liquid crystal display panel, each of said plurality of display lines having an order number of dots and each of said ordered number of dots having a number of bits, said liquid crystal display device, comprising:

means for splitting said image data of each of said display lines into a plurality of split blocks of said image data, wherein said plurality of split blocks of image data corresponds to a plurality of source drivers in a one-to-one manner, means for serially reading dot by dot each of said plurality of split blocks of said image data and further for transforming said image data of each of said dots in serial form;

means for serially transferring said image data in said serial form from each of said plurality of split blocks of said image data to a corresponding one of said plurality of source drivers;

means for transforming said image data received in serial form into image data in parallel form having a specified bit length;

means for combining said image data in parallel form from each of said plurality of source drivers in accordance with an arrangement of said source drivers;

means for converting said image data in parallel form to signals applied to outputs of said plurality of source drivers that correspond in a one-to-one manner to said ordered number of dots of each of said plurality of display lines to be displayed; and means for displaying said outputs of said plurality of source drivers to produce a display line corresponding to each of said plurality of display lines received from said external devices.

2. A liquid crystal display device that receives image data from external devices and displays said image data as a plurality of display lines on a liquid crystal display panel, each of said plurality of display lines having an order number of dots and each of said ordered number of dots having a number of bits, said liquid crystal display device, comprising:

a signal processing circuit that splits said image data into a plurality of split blocks of said image data, serially reads dot by dot each of said plurality of split blocks of said Image data and further transforms said image data of each of said dots in serial form; and a plurality of source drivers corresponding to said plurality of split blocks of said image data in a one-to-one manner, each of said plurality of source drivers receiving said image data in serial form from one of said plurality of split blocks of said image data and transforming said image data in serial form into image data in parallel form, wherein each of said plurality of source drivers has a plurality of ordered outputs, such that each of said plurality of ordered outputs of said plurality of source drivers corresponds in a one-to-one manner to said ordered number of dots and outputs a signal corresponding to said image data in parallel form for each of said ordered number of dots for each of said plurality of display lines to be displayed.

3. The liquid crystal display device according to claim 2, wherein said signal processing circuit includes at least two line memories, each of said at least two line memories storing one of said plurality of display lines of said image data according to said order of said plurality of split blocks of said image data.

4. The liquid crystal display device according to claim 2, wherein said signal processing circuit has a plurality of serial transforming circuits that transform each of said split blocks of said image data stored in each of said at least two line memories into said image data in serial form and each of said plurality of serial transforming circuits corresponds in a one-to-one manner to said plurality of split blocks of said image data arranged in said order.

5. The liquid crystal display device according to claim 4, wherein each of said plurality of serial transforming circuits serially transfers said image data in said serial form from one of said plurality of split blocks of said image data to a corresponding one of said plurality of source drivers.

6. The liquid crystal display device according to claim 2, wherein each of said plurality of source drivers includes a parallel transforming circuit that transforms said image data received in said serial form from a corresponding serial transforming circuit into parallel data having a specified bit length, which is applied to said plurality of ordered outputs.

7. A method of displaying image data received from external devices and displaying said image data as a plurality of display lines on a liquid crystal display panel, each of said plurality of display lines having an order number of dots and each of said ordered number of dots having a number of bits, said method of displaying image data, comprising:

splitting said image data of each of said display lines into a plurality of split blocks of said image data in units of dots, wherein said plurality of split blocks of image data corresponds to a plurality of source drivers in a one-to-one manner;

reading serially dot by dot each of said plurality of split blocks of said image data and transforming said image data of each of said dots in serial form;

transferring said image data in serial form from each of said plurality of split blocks of said image data to a corresponding one of said plurality of source drivers;

transforming said image data received in serial form into image data in parallel form having a specified bit length; and converting said image data in parallel form to signals applied to a plurality of outputs of said plurality of source drivers that correspond in a one-to-one manner to said ordered number of dots of each of said plurality of display lines to be displayed.

8. A method of displaying image data received from external devices and displaying said image data as a plurality of display lines on a liquid crystal display panel, each of said plurality of display lines having an order number of dots and each of said ordered number of dots having a number of bits, said method of displaying image data, comprising:

processing said image data by splitting a display line of said image data into a plurality of split blocks of said image data in units of dots, transforming each of said plurality of split blocks of said image data into image data in serial form, and serially transferring said image data in serial form to a plurality of source drivers that corresponds in a one-to-one manner to said plurality of split blocks of said image data in accordance with an arrangement of said source drivers;

transforming said image data received in serial form into parallel data having a specified bit length;

converting said image data in parallel form to signals applied to outputs of said plurality of source drivers that correspond in a one-to-one manner to said ordered number of dots of each of said plurality of display lines to be displayed; and displaying on said liquid crystal display panel, a display line corresponding to each of said plurality of display lines received from said external devices.

9. The method of displaying image data according to claim 8, wherein said processing of said image data includes storing one of said plurality of display lines of said image data according to said order of said plurality of split blocks of said image data in one of at least two line memories.

10. The method of displaying image data according to claim 8, wherein said processing of said image data includes transforming each of said split blocks of said image data stored in each of said at least two line memories into said image data in serial form.

11. The method of displaying image data according to claim 10, wherein said image data stored in each of said at least two line memories corresponds in a one-to-one manner to said plurality of split blocks of said image data arranged in said order.

12. The method of displaying image data according to claim 8, wherein transforming said image data received in serial form by each of said plurality of source drivers includes connecting said plurality of source drivers in parallel corresponding in a one-to-one manner with said plurality of split blocks of said image data arranged in said order, to produce an output corresponding to said image data received from said external devices, which is then transferred in parallel to said liquid crystal display panel.

13. A liquid crystal display device that receives image data from external devices and displays said image data as a plurality of display lines on a liquid crystal display panel, each of said plurality of display lines having an ordered number of dots and each of said ordered number of dots having a number of bits, said liquid crystal display device, comprising:

a plurality of source drivers located along a single edge of said liquid crystal display panel, each of said plurality of source drivers including an equal number of a plurality of outputs;

a signal processing circuit that splits said image data of each of said display lines into a plurality of split blocks of said image data in units of dots and transforms each of said plurality of split blocks of said image data into image data in serial form; and a plurality of serial data connections that transfer each of said plurality of split blocks of said image data for each of said display lines in serial form from said signal processing circuit to a corresponding one of said plurality of source drivers, wherein said plurality of serial data connections is connected in parallel and in an order such that each of said plurality of outputs of said plurality of source drivers corresponds in a one-to-one manner to said ordered number of dots.

14. The liquid crystal display device according to claim to claim 13, wherein said signal processing circuit is located new one end of said plurality of source drivers located along a single edge of said liquid crystal display panel.

15. The liquid crystal display device according to claim to claim 13, wherein said signal processing circuit is located near a center of said plurality of source drivers located along a single edge of said liquid crystal display panel.

* * * * *